US009708561B2

(12) United States Patent
Scherer et al.

(10) Patent No.: US 9,708,561 B2
(45) **Date of Patent: *Jul. 18, 2017**

(54) LUBRICATING OIL COMPOSITION WITH ENHANCED ENERGY EFFICIENCY

(71) Applicant: BASF SE, Ludwigshafen (DE)

(72) Inventors: Markus Scherer, Mannheim (DE); Arjun Goyal, West Deptford, NJ (US); Muriel Ecormier, Mannheim (DE); Boris Breitscheidel, Waldsee (DE)

(73) Assignee: BASF SE, Ludwigshafen (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/890,741

(22) PCT Filed: May 7, 2014

(86) PCT No.: PCT/EP2014/059338

§ 371 (c)(1),
(2) Date: Nov. 12, 2015

(87) PCT Pub. No.: WO2014/184068

PCT Pub. Date: Nov. 20, 2014

(65) Prior Publication Data

US 2016/0083667 A1 Mar. 24, 2016

(30) Foreign Application Priority Data

May 14, 2013 (EP) ..... 13167627
Aug. 22, 2013 (EP) ..... 13181269

(51) Int. Cl.
*C10M 117/00* (2006.01)
*C10M 105/42* (2006.01)
(Continued)

(52) U.S. Cl.
CPC ..... *C10M 105/36* (2013.01); *C10M 129/72* (2013.01); *C10M 2203/1006* (2013.01);
(Continued)

(58) Field of Classification Search
None
See application file for complete search history.

(56) References Cited

U.S. PATENT DOCUMENTS 2,921,089 A 1/1960 Hagemeyer et al.
3,087,936 A 4/1963 Suer
(Continued)

FOREIGN PATENT DOCUMENTS

CA 2637401 7/2007
DE 10201348 4/2003
(Continued)

OTHER PUBLICATIONS

PCT International Search Report in PCT/EP2014/059338, mailed Jul. 21, 2014, 4 pages.

*Primary Examiner* — Vishal Vasisth
(74) *Attorney, Agent, or Firm* — Drinker Biddle & Reath LLP

(57) ABSTRACT

A method for reducing the friction coefficient of a lubricating oil composition in the lubrication of a mechanical device comprises formulating said lubricating oil composition with a carboxylic acid ester obtainable by reacting a mixture comprising at least on dicarboxylic acid and at least one branched $C_{10}$ alcohol.

20 Claims, 2 Drawing Sheets

Figure 1:
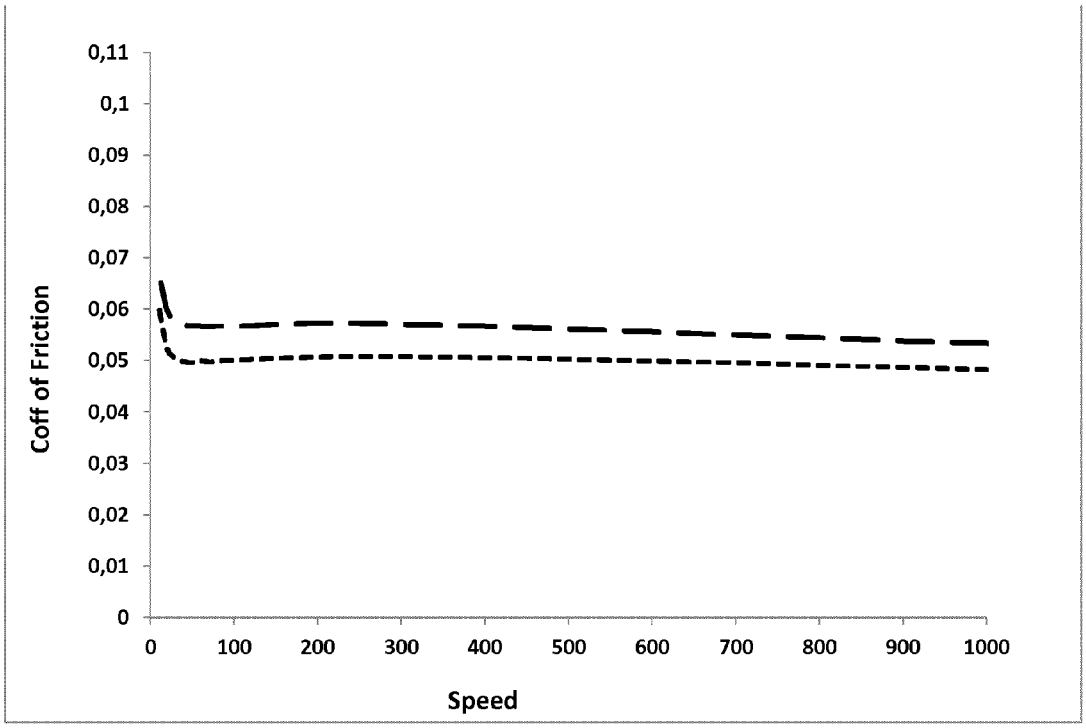

(51) Int. Cl.
*C10M 129/78* (2006.01)
*C10M 105/36* (2006.01)
*C10M 129/72* (2006.01)

(52) U.S. Cl.
CPC ..... *C10M 2203/1025* (2013.01); *C10M 2205/0285* (2013.01); *C10M 2207/282* (2013.01); *C10M 2207/2855* (2013.01); *C10M 2223/0405* (2013.01); *C10M 2229/025* (2013.01); *C10N 2230/06* (2013.01); *C10N 2240/02* (2013.01); *C10N 2240/04* (2013.01); *C10N 2240/10* (2013.01)

(56) References Cited

U.S. PATENT DOCUMENTS

| | | | |
|---|---|---|---|
| 3,172,892 | A | 3/1965 | Le Suer et al. |
| 3,254,025 | A | 5/1966 | Suer |
| 3,381,022 | A | 4/1968 | Le Suer |
| 3,382,291 | A | 5/1968 | Brennan et al. |
| 3,742,082 | A | 6/1973 | Brennan et al. |
| 3,769,363 | A | 10/1973 | Breannan et al. |
| 3,876,720 | A | 4/1975 | Heilman et al. |
| 4,149,178 | A | 4/1979 | Estes et al. |
| 4,234,435 | A | 11/1980 | Meinhardt et al. |
| 4,239,930 | A | 12/1980 | Allphin et al. |
| 4,367,352 | A | 1/1983 | Watts et al. |
| 4,370,247 | A | 1/1983 | Ostyn |
| 4,413,156 | A | 11/1983 | Watts, Jr. et al. |
| 4,434,408 | A | 2/1984 | Baba et al. |
| 4,910,355 | A | 3/1990 | Shubkin et al. |
| 4,956,122 | A | 9/1990 | Watts et al. |
| 5,068,487 | A | 11/1991 | Theriot |
| 5,135,638 | A | 8/1992 | Miller et al. |
| 5,246,566 | A | 9/1993 | Miller |
| 5,362,378 | A | 11/1994 | Borghard et al. |
| 5,565,086 | A | 10/1996 | Cody et al. |
| 2010/0093579 | A1 | 4/2010 | Boyde et al. |
| 2010/0261628 | A1* | 10/2010 | Scherer ..... C10M 105/34 508/496 |
| 2012/0202725 | A1 | 8/2012 | Grass et al. |
| 2012/0208731 | A1 | 8/2012 | Lann et al. |

FOREIGN PATENT DOCUMENTS

| | | |
|---|---|---|
| EP | 0321302 | 6/1989 |
| EP | 0321304 | 6/1989 |
| EP | 0710710 | 5/1996 |
| EP | 0767236 | 4/1997 |
| WO | WO-98/04658 | 2/1998 |
| WO | WO-2008/014315 | 1/2008 |
| WO | WO-2011/034829 | 3/2011 |

* cited by examiner

LUBRICATING OIL COMPOSITION WITH ENHANCED ENERGY EFFICIENCY

CROSS-REFERENCE TO RELATED APPLICATIONS

This application is the National Stage entry of PCT/EP2014/059338, filed on May 7, 2014, which claims priority to European Application Number 13167627.2, filed on May 14, 2013, and European Application Number 13181269.5, filed on Aug. 22, 2013, which are incorporated herein by reference in their entireties.

TECHNICAL FIELD

The presently claimed invention is directed to a method for reducing the friction coefficient of a lubricating oil composition in the lubrication of a mechanical device comprising formulating said lubricating oil composition with a carboxylic acid ester obtainable by reacting a mixture comprising at least on dicarboxylic acid and at least one branched $C_{10}$ alcohol.

BACKGROUND

The commercially available lubricating oil compositions are produced from a multitude of different natural or synthetic components. To improve the required properties, according to the field of use, further additives are usually added. The base oils often consist of mineral oils, highly refined mineral oils, alkylated mineral oils, poly-alpha-olefins (PAOs), polyalkylene glycols, phosphate esters, silicone oils, diesters and esters of polyhydric alcohols.

The different lubricants, such as motor oil, turbine oil, hydraulic fluid, transmission oil, compressor oil and the like, must satisfy extremely high criteria such as high viscosity index, good lubricant performance, high oxidation stability, good thermal stability or comparable properties.

High-performance lubricant oil formulations which are used as transmission, industrial or motor oils are oils with a special performance profile with regard to shear stability, low-temperature viscosity, long service life, evaporation loss, fuel efficiency, seal compatibility and wear protection. Such oils are currently being formulated preferentially with PAO (especially PAO 6) or group I, II or Group III mineral oils as carrier fluids, and with specific polymers (polyisobutylenes=PIBs, olefin copolymers=ethylene/propylene copolymers=OCPs, polyalkyl methacrylates=PMAs) as thickeners or viscosity index improvers in addition to the customary additive components. Together with PAOs, low-viscosity esters are typically being used, for example DIDA (diisodecyl adipate), DITA (diisotridecyl adipate) or TMTC (trimethylolpropane caprylate), especially as solubilizers for polar additive types and for optimizing seal compatibilities.

Esters are used as co-solvent, especially in motor oil, turbine oil, hydraulic fluid, transmission oil, compressor oil, but esters are also used as base oils, in which they are the main component.

EP 0 767 236 A1 discloses a gear lubricating oil composition. The composition contains more than 20% by volume a hydrogenated polyalphaolefin, and less than 80% by volume of mineral oil or synthetic ester oil or a combination thereof. The examples contain 10% by volume bis(tridecyl)-adipate.

WO 98/04658 A1 discloses base stocks for synthetic gear oils for use in heavy and medium duty axle gear lubricants and transmission fluid application. The lubricant disclosed therein contains 1% to 20% by weight of an ester. The ester includes diesters of $C_{8-13}$ adipates, in particular diisodecyl adipate.

U.S. Pat. No. 4,370,247 discloses a gear or axle lubricant containing 25 to 60 mass % of at least one di-$C_{8-12}$ alkyl ester of a dicarboxylic acid. The whole lubricant disclosed therein is reported to decrease power loss due to friction, therefore conserving fuel consumption.

CA 2 637 401 discloses a variety of diesters derived from a dicarboxylic acid having 2 to 36 carbon atoms and a branched alcohol having 4 to 40 carbon atoms. The lubricants can contain 0.1 to 100% by weight, or 5 to 99% by weight of the diesters.

WO 2011/34829 A1 discloses a method of lubricating a limited slip differential comprising supplying to the limited slip differential a lubricating composition comprising $C_{4-30}$ diester of adipic acid.

Although different lubricants, such as motor oil, turbine oil, hydraulic fluid, transmission oil, compressor oil and the like, satisfy extremely high criteria such as high viscosity index, good lubricant performance, high oxidation stability and good thermal stability, there is still a need to reduce the amount of energy consumed in operation of mechanical devices.

SUMMARY

Thus, it was an object of the presently claimed invention to provide a method that allows for operating mechanical devices at lower energy consumption.

The object was met by providing a method for reducing the friction coefficient of a lubricating oil composition in the lubrication of a mechanical device comprising formulating said lubricating oil composition with a carboxylic acid ester obtainable by reacting a mixture comprising a) at least one dicarboxylic acid, optionally in form of its anhydride, and b1) at least one monoalcohol having 10 carbon atoms and a structure of general formula I,

I

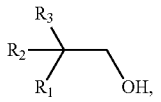

wherein $R^1$ is pentyl, $R^2$ is H and $R^3$ is propyl.

A BRIEF DESCRIPTION OF THE FIGURES

Figure 2:
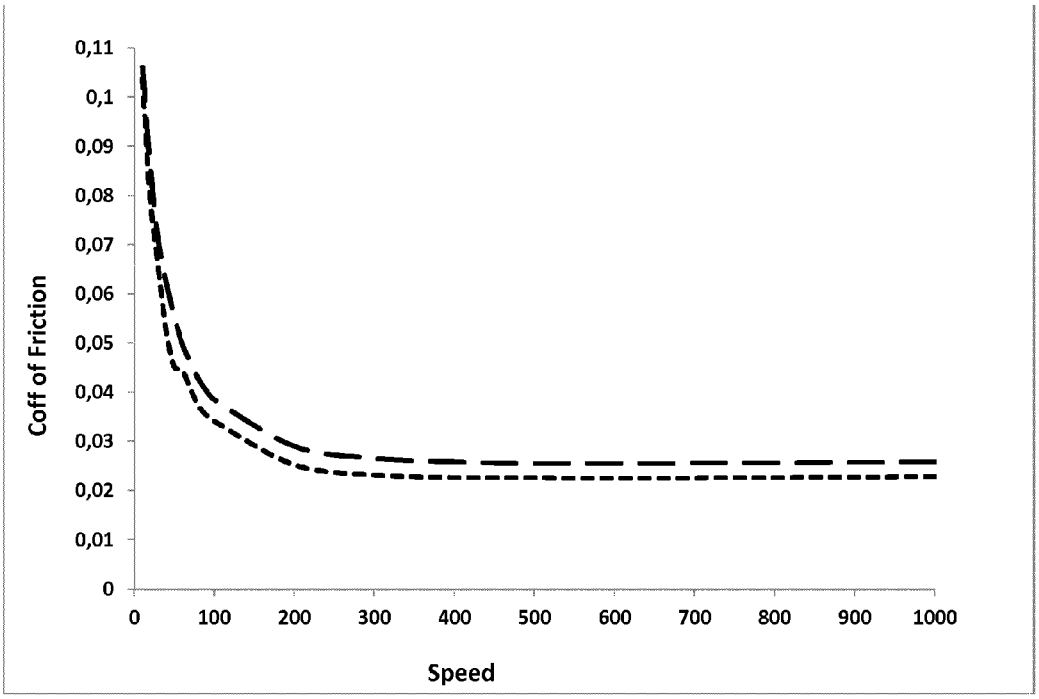

FIGS. 1 and 2 show the results of the MTM testing. In each case the upper curve is obtained from evaluation of Formulation A and the lower curve is obtained from evaluation of Formulation B.

FIG. 1 refers to the results when testing was carried out at 40° C.

FIG. 2 refers to the results to the results when testing was carried out at 100° C.

By the term lubricating oil composition, in the sense of the presently claimed invention, is meant a substance capable of reducing friction between moving surfaces.

DETAILED DESCRIPTION

The friction-modification properties are determined by measuring the friction coefficient at 25% slide roll ratio (SRR) using mini-traction machine (MTM) measurements at 70° C. and 1 GPa. Reducing the friction coefficient means in the sense of the presently claimed invention that the friction coefficient of a lubricating oil composition comprising a carboxylic acid ester as defined above is lower than the friction coefficient of a lubricating oil composition that does not contain said carboxylic acid ester.

A mechanical device in the sense of the presently claimed invention is a mechanism consisting of a device that works on mechanical principles.

Preferably the dicarboxylic acid is selected from the group consisting of phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkyl malonic acids, alkenyl malonic acids, glutaric acid, diglycolic acid, 1,4-cyclohexanedicarboxylic acid, 2,6-decahydronaphthalenedicarboxylic acid, 1,3-cyclohexanedicarboxylic acid and 2,5-norbornanedicarboxylic acid. More preferably the dicarboxylic acid is selected from the group consisting of glutaric acid, diglycolic acid, succinic acid, azelaic acid, sebacic acid, 1,4-cyclohexanedicarboxylic acid, adipic acid, 2,6-decahydronaphthalenedicarboxylic acid, 1,3-cyclohexanedicarboxylic acid and 2,5-norbornanedicarboxylic acid. Most preferably the aliphatic dicarboxylic acid is adipic acid.

The dicarboxylic acids can be used either in pure form or in the form of mixtures with monocarboxylic acids. Instead of the dicarboxylic acids, their anhydrides can also be used. Representative monocarboxylic acids include n-butanoic acid, n-pentanoic acid, n-hexanoic acid, n-heptanoic acid, n-octanoic acid, n-nonanoic acid, n-decanoic acid, isobutanoic acid, isopentanoic acid, isohexanoic acid, isoheptanoic acid, isooctanoic acid, 2-ethylhexanoic acid, isononanoic acid, 3,5,5-trimethylhexanoic acid, and isodecanoic acid.

Preferably the mixture further comprises a monoalcohol b2) having 10 carbon atoms and a structure of the general formula II,

II

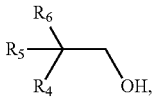

wherein $R_4$ is selected from the group consisting of pentyl, isopentyl, 2-methyl-butyl, 3-methyl-butyl and 2,2-dimethyl-propyl, $R_5$ is H or methyl and $R_6$ is selected from the group consisting of ethyl, propyl and iso-propyl, whereby the monoalcohol b1) and the monoalcohol b2) have a different structure.

Preferably the monoalcohol b2) is selected from the group consisting of 2-propyl-4-methyl-hexanol, 2-propyl-5-methyl-hexanol, 2-isopropyl-4-methyl-hexanol, 2-isopropyl-5-methyl-hexanol, 2-propyl-4,4-di methylpentanol, 2-ethyl-2,4-dimethylhexanol, 2-ethyl-2-methyl-heptanol, 2-ethyl-2,5-dimethylhexanol and 2-isopropyl-heptanol. More preferably the monoalcohol b2) is 2-propyl-4-methyl-hexanol.

Preferably the weight ratio of monoalcohol b1) to monoalcohol b2) is in the range of 5:1 to 95:1, more preferably in the range of 6:1 to 50:1, even more preferably in the range of 10:1 to 40:1, most preferably in the range of 20:1 to 35:1.

Preferably the mixture further comprises a monoalcohol b3) having 10 carbon atoms and a structure of the general formula III,

III

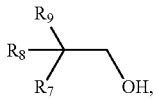

wherein $R_7$ is selected from the group consisting of pentyl, isopentyl, 2-methyl-butyl, 3-methyl-butyl and 2,2-dimethyl-propyl, $R_8$ is H or methyl, $R_9$ is selected from the group consisting of ethyl, propyl and iso-propyl.

Preferably the monoalcohol b3) has a different structure from both the monoalcohol b1) and the monoalcohol b2). Preferably the monoalcohol b3) is selected from the group consisting of 2-propyl-5-methyl-hexanol, 2-isopropyl-4-methyl-hexanol, 2-isopropyl-5-methyl-hexanol, 2-propyl-4,4-dimethylpentanol, 2-ethyl-2,4-dimethylhexanol, 2-ethyl-2-methyl-heptanol, 2-ethyl-2,5-dimethylhexanol and 2-isopropyl-heptanol. More preferably the monoalcohol b3) is 2-propyl-5-methyl-hexanol.

Preferably the mixture comprises 80 to 95 weight-% of 2-n-propyl-heptanol as component b1), 1.0 to 10 weight. % of 2-propyl-4-methyl-hexanol as component b2), 1.0 to 10 weight-% of 2-propyl-5-methyl-hexanol as component b3) and 0.1 to 2.0 weight-% of 2-isopropyl-heptanol, whereby the weight of each component is related to the total weight of the monoalcohols. More preferably the mixture comprises 91.0 to 95.0 weight-% of 2-n-propyl-heptanol as component b1), 2.0 to 5.0 weight-% of 2-propyl-4-methyl-hexanol as component b2), 3.0 to 5.0 weight-% of 2-propyl-5-methyl-hexanol as component b3) and 0.1 to 0.8 weight-% of 2-isopropyl-heptanol, whereby the weight of each component is related to the total weight of the monoalcohols.

Preferably the monoalcohol b1) is present in a molar ratio in the range of 2.05:1 to 3.0:1 in relation to the acid a), more preferably in the range of 2.1:1 to 2.5:1.

Preferably the lubricating oil composition comprises ≥1% to ≤10% by weight or ≥1% to ≤40% by weight or ≥20% to ≤100% by weight, more preferably ≥1% to ≤5% by weight or ≥1% to ≤35% by weight or ≥25% to ≤100% by weight, most preferably ≥1% to ≤2% by weight or ≥2% to ≤30% by weight or ≥30% to ≤100% by weight of at least one carboxylic acid ester as defined above, related to the total amount of the lubricating oil composition.

Preferably the lubricating oil composition further comprises further base stocks selected from the group consisting of mineral oils (Gr I, II or III oils), polyalphaolefins, polymerized and interpolymerized olefins, alkyl naphthalenes, alkylene oxide polymers, silicone oils, phosphate esters and carboxylic acid esters. Preferably the lubricating oil comprises 50% to 99% by weight or ≥80% to ≤99% by weight or ≥90% to ≤99% by weight base stocks, related to the total amount of the lubricating oil composition.

Definitions for the base stocks in this invention are the same as those found in the American Petroleum Institute (API) publication "Engine Oil Licensing and Certification System", Industry Services Department, Fourteenth Edition, December 1996, Addendum 1, December 1998. Said publication categorizes base stocks as follows:

a) Group I base stocks contain less than 90 percent saturates and/or greater than 0.03 percent sulphur and have a viscosity index greater than or equal to 80 and less than 120 using the test methods specified in the following table
b) Group II base stocks contain greater than or equal to 90 percent saturates and less than or equal to 0.03 percent sulphur and have a viscosity index greater than or equal to 80 and less than 120 using the test methods specified in the following table
c) Group III base stocks contain greater than or equal to 90 percent saturates and less than or equal to 0.03 percent sulphur and have a viscosity index greater than or equal to 120 using the test methods specified in the following table Analytical Methods for Base Stock

| Property | Test Method |
|---|---|
| Saturates | ASTM D 2007 |
| Viscosity Index | ASTM D 2270 |
| Sulphur | ASTM D 2622 |
| | ASTM D 4294 |
| | ASTM D 4927 |
| | ASTM D 3120 |

Synthetic lower viscosity fluids suitable for the presently claimed invention include the polyalphaolefins (PAOs) and the synthetic oils from the hydrocracking or hydroisomerization of Fischer Tropsch high boiling fractions including waxes. These are both stocks comprised of saturates with low impurity levels consistent with their synthetic origin. The hydroisomerized Fischer Tropsch waxes are highly suitable base stocks, comprising saturated components of iso-paraffinic character (resulting from the isomerization of the predominantly n-paraffins of the Fischer Tropsch waxes) which give a good blend of high viscosity index and low pour point. Processes for the hydroisomerization of Fischer Tropsch waxes are described in U.S. Pat. Nos. 5,362,378; 5,565,086; 5,246,566 and 5,135,638, as well in EP 710710, EP 321302 and EP 321304.

Polyalphaolefins suitable for the presently claimed invention, as either lower viscosity or high viscosity fluids depending on their specific properties, include known PAO materials which typically comprise relatively low molecular weight hydrogenated polymers or oligomers of alphaolefins which include but are not limited to $C_2$ to about $C_{32}$ alphaolefins with the $C_8$ to about $C_{16}$ alphaolefins, such as 1-octene, 1-decene, 1-dodecene and the like being preferred. The preferred polyalphaolefins are poly-1-octene, poly-1-decene, and poly-1-dodecene, although the dimers of higher olefins in the range of $C_{14}$ to $C_{18}$ provide low viscosity base stocks.

Low viscosity PAO fluids suitable for the presently claimed invention, may be conveniently made by the polymerization of an alphaolefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. For example, the methods disclosed by U.S. Pat. Nos. 4,149,178 or 3,382,291 may be conveniently used herein. Other descriptions of PAO synthesis are found in the following U.S. Pat. No. 3,742,082 (Brennan); U.S. Pat. No. 3,769,363 (Brennan); U.S. Pat. No. 3,876,720 (Heilman); U.S. Pat. No. 4,239,930 (Allphin); U.S. Pat. No. 4,367,352 (Watts); U.S. Pat. No. 4,413,156 (Watts); U.S. Pat. No. 4,434,408 (Larkin); U.S. Pat. No. 4,910,355 (Shubkin); U.S. Pat. No. 4,956,122 (Watts); and U.S. Pat. No. 5,068,487 (Theriot).

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkylbenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulphides and derivative, analogs and homologs thereof.

Further carboxylic acid esters suitable for the presently claimed invention include the esters of mono and polybasic acids with monoalkanols (simple esters) or with mixtures of mono and polyalkanols (complex esters), and the polyol esters of monocarboxylic acids (simple esters), or mixtures of mono and polycarboxylic acids (complex esters). Esters of the mono/polybasic type include, for example, the esters of monocarboxylic acids such as heptanoic acid, and dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, or mixtures thereof with polyalkanols, etc. Specific examples of these types of esters include nonyl heptanoate, dibutyl adipate, di(2-ethylhexyl) sebacate, di-n-hexyl fumarate, dioctyl sebacatediisooctyl azelate, diisodecyl azelate, dioctyl phthalate, didecyl phthalate, dieicosyl sebacate, dibutyl-TMP-adipate, etc.

Also suitable for the presently claimed invention are esters, such as those obtained by reacting one or more polyhydric alcohols, preferably the hindered polyols such as the neopentyl polyols, e.g. neopentyl glycol, trimethylol ethane, 2-methyl-2-propyl-1,3-propanediol, trimethylol propane, trimethylol butane, pentaerythritol and dipentaerythritol with monocarboxylic acids containing at least 4 carbons, normally the $C_5$ to $C_{30}$ acids such as saturated straight chain fatty acids including caprylic acid, capric acid, lauric acid, myristic acid, palmitic acid, stearic acid, arachic acid, and behenic acid, or the corresponding branched chain fatty acids or unsaturated fatty acids such as oleic acid, or mixtures thereof, with polycarboxylic acids.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 or diphenyl ether of poly-ethylene glycol having a molecular weight of 1000 to 1500); and mono- and polycarboxylic esters thereof, for example, the acetic acid esters, mixed $C_3$-$C_8$ fatty acid esters and $C_{13}$ Oxo acid diester of tetraethylene glycol.

Silicon-based oils such as the polyalkyl-, polyaryl-, polyalkoxy- or polyaryloxysilicone oils and silicate oils comprise another useful class of synthetic lubricants; such oils include tetraethyl silicate, tetraisopropyl silicate, tetra-(2-ethylhexyl)silicate, tetra-(4-methyl-2-ethylhexyl)silicate, tetra-(p-tert-butyl-phenyl) silicate, hexa-(4-methyl-2-ethyl-hexyl)disiloxane, oly(methyl)siloxanes and poly(methylphenyl)siloxanes. Other synthetic lubricating oils include liquid esters of phosphorous-containing acids (e.g., tricresyl phosphate, trioctyl phosphate, diethyl ester of decylphosphonic acid) and polymeric tetrahydrofurans.

The lubricating oil composition of the invention optionally further includes at least one other performance additive. The other performance additives include dispersants, metal deactivators, detergents, viscosity modifiers, extreme pressure agents (typically boron- and/or sulphur- and/or phosphorus-containing), antiwear agents, antioxidants (such as hindered phenols, aminic antioxidants or molybdenum compounds), corrosion inhibitors, foam inhibitors, demulsifiers, pour point depressants, seal swelling agents, friction modifiers and mixtures thereof.

The total combined amount of the other performance additives (excluding the viscosity modifiers) present on an oil free basis may include ranges of 0% by weight to 25% by weight, or 0.01% by weight to 20% by weight, or 0.1% by weight to 15% by weight or 0.5% by weight to 10% by weight, or 1 to 5% by weight of the composition.

Although one or more of the other performance additives may be present, it is common for the other performance additives to be present in different amounts relative to each other.

In one embodiment the lubricating composition further includes one or more viscosity modifiers.

When present the viscosity modifier may be present in an amount of 0.5% by weight to 70% by weight, 1% by weight to 60% by weight, or 5% by weight to 50% by weight, or 10% by weight to 50% by weight of the lubricating composition.

Viscosity modifiers include (a) polymethacrylates, (b) esterified copolymers of (i) a vinyl aromatic monomer and (ii) an unsaturated carboxylic acid, anhydride, or derivatives thereof, (c) esterified interpolymers of (i) an alpha-olefin; and (ii) an unsaturated carboxylic acid, anhydride, or derivatives thereof, or (d) hydrogenated copolymers of styrene-butadiene, (e) ethylene-propylene copolymers, (f) polyisobutenes, (g) hydrogenated styrene-isoprene polymers, (h) hydrogenated isoprene polymers, or (i) mixtures thereof.

In one embodiment the viscosity modifier includes (a) a polymethacrylate, (b) an esterified copolymer of (i) a vinyl aromatic monomer; and (ii) an unsaturated carboxylic acid, anhydride, or derivatives thereof, (c) an esterified interpolymer of (i) an alpha-olefin; and (ii) an unsaturated carboxylic acid, anhydride, or derivatives thereof, or (d) mixtures thereof.

Extreme pressure agents include compounds containing boron and/or sulphur and/or phosphorus.

The extreme pressure agent may be present in the lubricating composition at 0% by weight to 20% by weight, or 0.05% by weight to 10% by weight, or 0.1% by weight to 8% by weight of the lubricating composition.

In one embodiment the extreme pressure agent is a sulphur-containing compound. In one embodiment the sulphur-containing compound may be a sulphurised olefin, a polysulphide, or mixtures thereof. Examples of the sulphurised olefin include a sulphurised olefin derived from propylene, isobutylene, pentene; an organic sulphide and/or polysulphide including benzyldisulphide; bis-(chlorobenzyl) disulphide; dibutyl tetrasulphide; di-tertiary butyl polysulphide; and sulphurised methyl ester of oleic acid, a sulphurised alkylphenol, a sulphurised dipentene, a sulphurised terpene, a sulphurised Diels-Alder adduct, an alkyl sulphenyl N'N-dialkyl dithiocarbamates; or mixtures thereof.

In one embodiment the sulphurised olefin includes a sulphurised olefin derived from propylene, isobutylene, pentene or mixtures thereof.

In one embodiment the extreme pressure agent sulphur-containing compound includes a dimercaptothiadiazole or derivative, or mixtures thereof. Examples of the dimercaptothiadiazole include compounds such as 2,5-dimercapto-1,3,4-thiadiazole or a hydrocarbyl-substituted 2,5-dimercapto-1,3,4-thiadiazole, or oligomers thereof. The oligomers of hydrocarbyl-substituted 2,5-dimercapto-1,3,4-thiadiazole typically form by forming a sulphur-sulphur bond between 2,5-dimercapto-1,3,4-thiadiazole units to form derivatives or oligomers of two or more of said thiadiazole units. Suitable 2,5-dimercapto-1,3,4-thiadiazole derived compounds include for example 2,5-bis(tert-nonyldithio)-1,3,4-thiadiazole or 2-tert-nonyldithio-5-mercapto-1,3,4-thiadiazole. The number of carbon atoms on the hydrocarbyl substituents of the hydrocarbyl-substituted 2,5-dimercapto-1,3,4-thiadiazole typically include 1 to 30, or 2 to 20, or 3 to 16.

In one embodiment the dimercaptothiadiazole may be a thiadiazole-functionalised dispersant. A detailed description of the thiadiazole-functionalised dispersant is described is paragraphs [0028] to [0052] of International Publication WO 2008/014315.

The thiadiazole-functionalised dispersant may be prepared by a method including heating, reacting or complexing a thiadiazole compound with a dispersant substrate. The thiadiazole compound may be covalently bonded, salted, complexed or otherwise solubilised with a dispersant, or mixtures thereof.

The relative amounts of the dispersant substrate and the thiadiazole used to prepare the thiadiazole-functionalised dispersant may vary. In one embodiment the thiadiazole compound is present at 0.1 to 10 parts by weight relative to 100 parts by weight of the dispersant substrate. In different embodiments the thiadiazole compound is present at greater than 0.1 to 9, or greater than 0.1 to less than 5, or 0.2 to less than 5:to 100 parts by weight of the dispersant substrate. The relative amounts of the thiadiazole compound to the dispersant substrate may also be expressed as (0.1-10):100, or (>0.1-9):100, (such as (>0.5-9):100), or (0.1 to less than 5):100, or (0.2 to less than 5):100.

In one embodiment the dispersant substrate is present at 0.1 to 10 parts by weight relative to 1 part by weight of the thiadiazole compound. In different embodiments the dispersant substrate is present at greater than 0.1 to 9, or greater than 0.1 to less than 5, or about 0.2 to less than 5:to 1 part by weight of the thiadiazole compound. The relative amounts of the dispersant substrate to the thiadiazole compound may also be expressed as (0.1-10):1, or (>0.1-9):1, (such as (>0.5-9):1), or (0.1 to less than 5):1, or (0.2 to less than 5):1.

The thiadiazole-functionalised dispersant may be derived from a substrate that includes a succinimide dispersant (for example, N-substituted long chain alkenyl succinimides, typically a polyisobutylene succinimide), a Mannich dispersant, an ester-containing dispersant, a condensation product of a fatty hydrocarbyl monocarboxylic acylating agent with an amine or ammonia, an alkyl amino phenol dispersant, a hydrocarbyl-amine dispersant, a polyether dispersant, a polyetheramine dispersant, a viscosity modifier containing dispersant functionality (for example polymeric viscosity index modifiers (VMs) containing dispersant functionality), or mixtures thereof. In one embodiment the dispersant substrate includes a succinimide dispersant, an ester-containing dispersant or a Mannich dispersant.

In one embodiment the extreme pressure agent includes a boron-containing compound. The boron-containing compound includes a borate ester (which in some embodiments may also be referred to as a borated epoxide), a borated alcohol, a borated dispersant, a borated phospholipid or mixtures thereof. In one embodiment the boron-containing compound may be a borate ester or a borated alcohol.

The borate ester may be prepared by the reaction of a boron compound and at least one compound selected from epoxy compounds, halohydrin compounds, epihalohydrin compounds, alcohols and mixtures thereof. The alcohols include dihydric alcohols, trihydric alcohols or higher alcohols, with the proviso for one embodiment that hydroxyl groups are on adjacent carbon atoms, i.e., vicinal.

Boron compounds suitable for preparing the borate ester include the various forms selected from the group consisting of boric acid (including metaboric acid, orthoboric acid and tetraboric acid), boric oxide, boron trioxide and alkyl borates. The borate ester may also be prepared from boron halides.

In one embodiment suitable borate ester compounds include tripropyl borate, tributyl borate, tripentyl borate, trihexyl borate, triheptyl borate, trioctyl borate, trinonyl borate and tridecyl borate. In one embodiment the borate ester compounds include tributyl borate, tri-2-ethylhexyl borate or mixtures thereof.

In one embodiment, the boron-containing compound is a borated dispersant, typically derived from an N-substituted long chain alkenyl succinimide. In one embodiment the borated dispersant includes a polyisobutylene succinimide. Borated dispersants are described in more detail in U.S. Pat. Nos. 3,087,936; and 3,254,025.

In one embodiment the borated dispersant may be used m combination with a sulphur-containing compound or a borate ester.

In one embodiment the extreme pressure agent is other than a borated dispersant.

The number average molecular weight of the hydrocarbon from which the long chain alkenyl group was derived includes ranges of 350 to 5000, or 500 to 3000, or 550 to 1500. The long chain alkenyl group may have a number average molecular weight of 550, or 750, or 950 to 1000.

The N-substituted long chain alkenyl succinimides are borated using a variety of agents including boric acid (for example, metaboric acid, orthoboric acid and tetraboric acid), boric oxide, boron trioxide, and alkyl borates. In one embodiment the borating agent is boric acid which may be used alone or in combination with other borating agents.

The borated dispersant may be prepared by blending the boron compound and the N-substituted long chain alkenyl succinimides and heating them at a suitable temperature, such as, 80° C. to 250° C., or 90° C. to 230° C., or 100° C. to 210° C., until the desired reaction has occurred. The molar ratio of the boron compounds to the N-substituted long chain alkenyl succinimides may have ranges including 10:1 to 1:4, or 4:1 to 1:3; or the molar ratio of the boron compounds to the N-substituted long chain alkenyl succinimides may be 1:2. Alternatively, the ratio of moles B:moles N (that is, atoms of B:atoms of N) in the borated dispersant may be 0.25:1 to 10:1 or 0.33:1 to 4:1 or 0.2:1 to 1.5:1, or 0.25:1 to 1.3:1 or 0.8:1 to 1.2:1 or about 0.5:1 An inert liquid may be used in performing the reaction. The liquid may include toluene, xylene, chlorobenzene, dimethylformamide or mixtures thereof.

In one embodiment the lubricating composition further includes a borated phospholipid. The borated phospholipid may be derived from boronation of a phospholipid (for example boronation may be carried out with boric acid). Phospholipids and lecithins are described in detail in Encyclopedia of Chemical Technology, Kirk and Othmer, 3rd Edition, in "Fats and Fatty Oils", Volume 9, pages 795-831 and in "Lecithins", Volume 14, pages 250-269.

The phospholipid may be any lipid containing a phosphoric acid, such as lecithin or cephalin, or derivatives thereof. Examples of phospholipids include phosphatidylcholine, phosphatidylserine, phosphatidylinositol, phosphatidylethanolamine, phosphotidic acid and mixtures thereof. The phospholipids may be glycerophospholipids, glycero derivatives of the above list of phospholipids. Typically, the glycerophospholipids have one or two acyl, alkyl or alkenyl groups on a glycerol residue. The alkyl or alkenyl groups may contain 8 to 30, or 8 to 25, or 12 to 24 carbon atoms. Examples of suitable alkyl or alkenyl groups include octyl, dodecyl, hexadecyl, octadecyl, docosanyl, octenyl, dodecenyl, hexadecenyl and octadecenyl.

Phospholipids may be prepared synthetically or derived from natural sources. Synthetic phospholipids may be prepared by methods known to those in the art. Naturally derived phospholipids are often extracted by procedures known to those in the art. Phospholipids may be derived from animal or vegetable sources. A useful phospholipid is derived from sunflower seeds. The phospholipid typically contains 35% to 60% phosphatidylcholine, 20% to 35% phosphatidylinositol, 1% to 25% phosphatidic acid, and 10% to 25% phosphatidylethanolamine, wherein the percentages are by weight based on the total phospholipids. The fatty acid content may be 20% by weight to 30% by weight palmitic acid, 2% by weight to 10% by weight stearic acid, 15% by weight to 25% by weight oleic acid, and 40% by weight to 55% by weight linoleic acid.

Friction modifiers may include fatty amines, esters such as borated glycerol esters, fatty phosphites, fatty acid amides, fatty epoxides, borated fatty epoxides, alkoxylated fatty amines, borated alkoxylated fatty amines, metal salts of fatty acids, or fatty imidazolines, condensation products of carboxylic acids and polyalkylene-polyamines.

In one embodiment the lubricating composition may contain phosphorus- or sulphur-containing antiwear agents other than compounds described as an extreme pressure agent of the amine salt of a phosphoric acid ester described above. Examples of the antiwear agent may include a non-ionic phosphorus compound (typically compounds having phosphorus atoms with an oxidation state of +3 or +5), a metal dialkyldithiophosphate (typically zinc dialkyldithiophosphates), a metal mono- or di-alkylphosphate (typically zinc phosphates), or mixtures thereof.

The non-ionic phosphorus compound includes a phosphite ester, a phosphate ester, or mixtures thereof.

In one embodiment the lubricating composition of the invention further includes a dispersant. The dispersant may be a succinimide dispersant (for example N-substituted long chain alkenyl succinimides), a Mannich dispersant, an ester-containing dispersant, a condensation product of a fatty hydrocarbyl monocarboxylic acylating agent with an amine or ammonia, an alkyl amino phenol dispersant, a hydrocarbyl-amine dispersant, a polyether dispersant or a polyether-amine dispersant.

In one embodiment the succinimide dispersant includes a polyisobutylene-substituted succinimide, wherein the polyisobutylene from which the dispersant is derived may have a number average molecular weight of 400 to 5000, or 950 to 1600.

Succinimide dispersants and their methods of preparation are more fully described in U.S. Pat. Nos. 4,234,435 and 3,172,892.

Suitable ester-containing dispersants are typically high molecular weight esters. These materials are described in more detail in U.S. Pat. No. 3,381,022.

In one embodiment the dispersant includes a borated dispersant. Typically the borated dispersant includes a succinimide dispersant including a polyisobutylene succinimide, wherein the polyisobutylene from which the dispersant is derived may have a number average molecular weight of 400 to 5000. Borated dispersants are described in more detail above within the extreme pressure agent description.

Dispersant viscosity modifiers (often referred to as DVMs) include functionalised polyolefins, for example, ethylene-propylene copolymers that have been functionalized with the reaction product of maleic anhydride and an amine, a polymethacrylate functionalised with an amine, or esterified styrene-maleic anhydride copolymers reacted with an amine may also be used in the composition of the invention.

Corrosion inhibitors include 1-amino-2-propanol, octylamine octanoate, condensation products of dodecenyl succinic acid or anhydride and/or a fatty acid such as oleic acid with a polyamine.

Metal deactivators include derivatives of benzotriazoles (typically tolyltriazole), 1,2,4-triazoles, benzimidazoles, 2-alkyldithiobenzimidazoles or 2-alkyldithiobenzothiazoles. The metal deactivators may also be described as corrosion inhibitors.

Foam inhibitors include copolymers of ethyl acrylate and 2-ethylhexyl acrylate and optionally vinyl acetate.

Demulsifiers include trialkyl phosphates, and various polymers and copolymers of ethylene glycol, ethylene oxide, propylene oxide, or mixtures thereof.

Pour point depressants including esters of maleic anhydride-styrene, polymethacrylates, polyacrylates or polyacrylamides.

Seal swell agents including Exxon Necton-37™ (FN 1380) and Exxon Mineral Seal Oil™ (FN 3200).

The lubricating oil composition of the presently claimed invention can be used for various applications such as light, medium and heavy duty engine oils, industrial engine oils, marine engine oils, crankshaft oils, compressor oils, refrigerator oils, hydrocarbon compressor oils, very low-temperature lubricating oils and fats, high temperature lubricating oils and fats, wire rope lubricants, textile machine oils, refrigerator oils, aviation and aerospace lubricants, aviation turbine oils, transmission oils, gas turbine oils, spindle oils, spin oils, traction fluids, transmission oils, plastic transmission oils, passenger car transmission oils, truck transmission oils, industrial transmission oils, industrial gear oils, insulating oils, instrument oils, brake fluids, transmission liquids, shock absorber oils, heat distribution medium oils, transformer oils, fats, chain oils, minimum quantity lubricants for metalworking operations, oil to the warm and cold working, oil for water-based metalworking liquids, oil for neat oil metalworking fluids, oil for semi-synthetic metalworking fluids, oil for synthetic metalworking fluids, drilling detergents for the soil exploration, hydraulic oils, in biodegradable lubricants or lubricating greases or waxes, chain saw oils, release agents, moulding fluids, gun, pistol and rifle lubricants or watch lubricants and food grade approved lubricants.

The mechanical device is preferably selected from the group consisting of bearings, gears, joints and guidances. Preferably the mechanical device is operated at temperatures in the range of ≥10° C. to ≤120° C.

EXAMPLES

Preparation of Ester Compounds

Propylheptanol is commercially available from BASF SE, Ludwigshafen [93.0% by weight 2-propyl-heptanol; 2.9% by weight 2-propyl-4-methyl-hexanol; 3.9% by weight 2-propyl-5-methylhexanol and 0.2 Gew.-% 2-isopropylheptanol]

DIDA is commercially available for example as Synative® ES DIDA from BASF SE, Ludwigshafen.

Preparation of Di-(2-Propylheptyl)-Adipate (DPHA)

A mixture of structural isomers of an alcohol with 10 carbon atoms which is available by BASF SE as "propylheptanol" (2.4 mol) and adipic acid (1.0 mol) is reacted in the present of iso-propyl-butyl-titanate (0.001 mol) in an autoclave under inert gas ($N_2$) at a reaction temperature of 230° C. Water which is formed during the reaction is removed from the reaction mixture through an inert gas stream ($N_2$-stream). After 180 minutes the excess alcohol is removed from the mixture by distillation at a pressure of 50 mbar. The thus obtained adipic acid ester is then neutralised with 0.5% NaOH at 80° C. Afterwards the organic phase and the aqueous phase are separated, followed by washing the organic phase two times with water. In a further step the organic phase is purified by treating the crude adipic acid ester with steam at 180° C. and 50 mbar. Then the ester is dried by subjecting it to a $N_2$ stream at 150° C. and 50 mbar. Finally the ester is mixed with activated carbon and is filtered using as a rheological agent supra-theorit at 80° C. under reduced pressure. The adipic acid ester shows a density of 0.916 g/cm$^3$ at 20° C., measured according to DIN 51757, respectively ASTM D 4052.

Preparation of Lubricant Formulations

TABLE 1

Lubricant formulations A and B (all values in weight-%)

| | Formulation A with DIDA | Formulation B with DPHA |
|---|---|---|
| PAO 6 (Nexbase ® 2006, polyalphaolefin, obtainable from Neste Oil N.V, Belgium) | 52.0% | 52.0% |
| DIDA | 10.0% | — |
| DPHA | — | 10.0% |
| Thickener (Lubrizol ® 8406, polyisobutylene, available from Lubrizol) | 13.0% | 13.0% |
| Thickener (Lubrizol ® 8407 from Lubrizol) | 13.0% | 13.0% |
| Additives (Anglamol ® 6004, additive package available from Lubrizol) | 12.0% | 12.0% |

Friction Coefficient Evaluation

The fluids were tested in the MTM (Mini-Traction Machine) instrument using the so-called traction test mode. In this mode, the friction coefficient is measured at a constant mean speed over a range of slide roll ratios (SRR) to give the traction curve. SRR=sliding speed/mean entrainment speed=2 (U1−U2)/(U1+U2) in which U1 and U2 are the ball and disc speeds respectively The disc and ball used for the experiments were made of steel (AISI 52100), with a hardness of 750 HV and Ra<0.02 μm. The diameter was 45.0 mm and 19.0 mm for the disc and the ball respectively. The tractions curves were run with 1.00 GPa contact pressure, 10 to 1000 m/s speed and different temperatures such as 40° C. and 100° C. The slide-roll ratio (SRR) was 50% and the friction coefficient measured. Each sample (20 ml) was run three times.

Results of the Evaluation

The results of the MTM testing are shown in FIGS. 1 and 2. In each case the upper curve is obtained from evaluation of Formulation A and the lower curve is obtained from evaluation of Formulation B. FIG. 1 refers to the results when testing was carried out at 40° C., whereas FIG. 2 refers to the results to the results when testing was carried out at 100° C.

In each case the formulations containing esters according to the presently claimed invention show a significantly lower coefficient of friction.

The invention claimed is:

1. A method for reducing the friction coefficient of a lubricating oil composition in the lubrication of a mechanical device comprising:

formulating said lubricating oil composition with a carboxylic acid ester obtainable by reacting a mixture comprising:

a) at least one dicarboxylic acid, optionally in form of its anhydride, b1) at least one monoalcohol having 10 carbon atoms and a structure of general formula I,

I

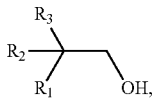

wherein $R_1$ is pentyl, $R_2$ is H and $R_3$ is propyl and b2) a monoalcohol having 10 carbon atoms and a structure of the general formula II,

II

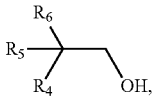

wherein $R_4$ is selected from the group consisting of pentyl, isopentyl, 2-methyl-butyl, 3-methyl-butyl and 2,2-dimethyl-propyl, $R_5$ is H or methyl and $R_6$ is selected from the group consisting of ethyl, propyl and iso-propyl, whereby the monoalcohol b1) and the monoalcohol b2) have a different structure.

2. The method according to claim 1, wherein the friction coefficient is measured at 25% slide roll ratio (SRR) using mini-traction machine (MTM) measurements at 70° C. and 1 GPa.

3. The method according to claim 1, wherein the dicarboxylic acid is selected from the group consisting of: phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkyl malonic acids, alkenyl malonic acids, glutaric acid, diglycolic acid, 1,4-cyclohexanedicarboxylic acid, 2,6-decahydronaphthalenedicarboxylic acid, 1,3-cyclohexanedicarboxylic acid, and 2,5-norbornanedicarboxylic acid.

4. The method according to claim 3, wherein the dicarboxylic acid is selected from the group consisting of: glutaric acid, diglycolic acid, succinic acid, azelaic acid, sebacic acid, 1,4-cyclohexanedicarboxylic acid, adipic acid, 2,6-decahydronaphthalenedicarboxylic acid, 1,3-cyclohexanedicarboxylic acid and 2,5-norbornanedicarboxylic acid.

5. The method according to claim 4, wherein the dicarboxylic acid is adipic acid.

6. The method according to claim 1, wherein weight ratio of monoalcohol b1) to monoalcohol b2) is in the range of 5:1 to 95:1.

7. The method according to claim 1, wherein the monoalcohol b1) is present in a molar ratio in the range of 2.05:1 to 3.0:1 in relation to the acid a).

8. The method according to claim 1, wherein the lubricating oil composition comprises ≥1% to ≤10% by weight of the at least one carboxylic acid ester, relative to the total amount of the lubricating oil composition.

9. The method according to claim 1, wherein the lubricating oil composition further comprises base stocks selected from the group consisting of mineral oils (Gr I, II or III oils), polyalphaolefins, polymerized and interpolymerized olefins, alkyl naphthalenes, alkylene oxide polymers, silicone oils and phosphate esters.

10. The method according to claim 9, wherein the lubricating oil comprises ≥1% to ≤49% by weight base stocks, relative to the total amount of the lubricating oil composition.

11. The method according to claim 1, wherein the mechanical device is selected from the group consisting of bearings, actuator, gears, piston, cranked shaft, joints, and guidances.

12. The method according to claim 1, wherein the mechanical device is operated at temperatures in the range of ≥10° C. to ≤120° C.

13. The method according to claim 1, wherein the lubricating oil composition comprises ≥1% to ≤40% by weight of the at least one carboxylic acid ester, relative to the total amount of the lubricating oil composition.

14. The method according to claim 1, wherein the lubricating oil composition comprises ≥20% to ≤100% by weight of the at least one carboxylic acid ester, relative to the total amount of the lubricating oil composition.

15. The method according to claim 9, wherein the lubricating oil comprises ≥50% to ≤99% by weight base stocks, relative to the total amount of the lubricating oil composition.

16. The method according to claim 1, wherein weight ratio of monoalcohol b1) to monoalcohol b2) is in the range of 10:1 to 40:1.

17. The method according to claim 1, wherein weight ratio of monoalcohol b1) to monoalcohol b2) is in the range of 20:1 to 35:1.

18. A method for reducing the friction coefficient of a lubricating oil composition in the lubrication of a mechanical device comprising:

formulating said lubricating oil composition with a carboxylic acid ester obtained by reacting a mixture comprising:

b) at least one dicarboxylic acid, optionally in form of its anhydride, b1) at least one monoalcohol having 10 carbon atoms and a structure of general formula I,

I

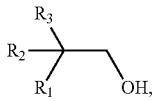

wherein $R_1$ is pentyl, $R_2$ is H and $R_3$ is propyl and b2) a monoalcohol having 10 carbon atoms and a structure of the general formula II,

II

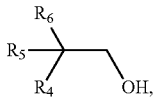

wherein $R_4$ is selected from the group consisting of pentyl, isopentyl, 2-methyl-butyl, 3-methyl-butyl and 2,2-dimethyl-propyl, $R_5$ is H or methyl and $R_6$ is selected from the group consisting of ethyl, propyl and iso-propyl, whereby the monoalcohol b1) and the monoalcohol b2) have a different structure wherein weight ratio of monoalcohol b1) to monoalcohol b2) is in the range of 5:1 to 95:1, and the monoalcohol b1) is present in a molar ratio in the range of 2.05:1 to 3.0:1 in relation to the acid a) and lubricating the mechanical device with the lubricating oil composition.

19. The method according to claim 18, wherein the mechanical device is selected from the group consisting of bearings, actuator, gears, piston, cranked shaft, joints, and guidances and the mechanical device is operated at temperatures in the range of ≥10° C. to ≤120° C.

20. The method according to claim 19, wherein weight ratio of monoalcohol b1) to monoalcohol b2) is in the range of 20:1 to 35:1 and the dicarboxylic acid is adipic acid.

* * * * *